US012449244B2

(12) United States Patent
Leppänen et al.

(10) Patent No.: US 12,449,244 B2
(45) Date of Patent: Oct. 21, 2025

(54) HOLDER DEVICE

(71) Applicant: KING COMPETITION PRODUCTS OY, Lahti (FI)

(72) Inventors: Kim Leppänen, Lahti (FI); Emil Järvinen, Lahti (FI)

(73) Assignee: KING COMPETITION PRODUCTS OY, Lahti (FI)

( * ) Notice: Subject to any disclaimer, the term of this patent is extended or adjusted under 35 U.S.C. 154(b) by 65 days.

(21) Appl. No.: 18/294,289

(22) PCT Filed: Aug. 18, 2022

(86) PCT No.: PCT/FI2022/050538
§ 371 (c)(1),
(2) Date: Feb. 1, 2024

(87) PCT Pub. No.: WO2023/031506
PCT Pub. Date: Mar. 9, 2023

(65) Prior Publication Data

US 2025/0093139 A1 Mar. 20, 2025

(30) Foreign Application Priority Data

Sep. 2, 2021 (FI) ..... 20215918

(51) Int. Cl.
*A45F 5/02* (2006.01)
*A45F 5/00* (2006.01)
(Continued)

(52) U.S. Cl.
CPC ..... *F42B 39/002* (2013.01); *A45F 5/02* (2013.01); *A45F 5/1583* (2025.01); *F42B 39/02* (2013.01)

(58) Field of Classification Search
CPC ..... A45F 5/021; F42B 39/002; F42B 39/22; F42B 9/00; F42B 39/02; Y10S 224/931; Y10S 206/804
(Continued)

(56) References Cited

U.S. PATENT DOCUMENTS 225,169 A * 3/1880 Sauerbray ..... A45F 5/02 224/196
1,163,369 A * 12/1915 Ross ..... F42B 39/02 224/199
(Continued)

FOREIGN PATENT DOCUMENTS

WO 2011015854 A1 2/2011
WO 2020245507 A1 12/2020

OTHER PUBLICATIONS

International Search Report for PCT/FI2022/050538 mailed Nov. 22, 2022, 3 pages.
(Continued)

*Primary Examiner* — Adam J Waggenspack
(74) *Attorney, Agent, or Firm* — NIXON & VANDERHYE

(57) ABSTRACT

A holder device for holding objects includes a holder body, a moveable carrier element, and a force generating system tending to move the carrier element in a first direction to a first position when the carrier element is in a second position away from the first position. The carrier element constitutes a trough having a longitudinal direction perpendicular to the first direction, a wider area closer to a bottom of the trough, and a narrower area farther from the bottom of the trough. When the carrier element is in the first position, a rim of the holder body closes the trough so that the objects cannot be moved in the longitudinal direction to and from the trough. When the carrier element is in the second position, the
(Continued)

objects can be moved in the longitudinal direction to and from the trough.

20 Claims, 6 Drawing Sheets

(51) Int. Cl.
*F42B 39/00* (2006.01)
*F42B 39/02* (2006.01)

(58) Field of Classification Search
USPC .... 224/931, 242, 537; 206/3, 804, 303, 346; 221/187, 266, 264, 263, 185
See application file for complete search history.

(56) References Cited

U.S. PATENT DOCUMENTS

| | | | | |
|---|---|---|---|---|
| 2,837,259 | A * | 6/1958 | Blanchard | F42B 39/02 224/199 |
| 3,286,890 | A | 11/1966 | Hildebrandt | |
| 6,050,464 | A * | 4/2000 | Ramsey, Sr. | F41C 27/00 224/931 |
| 9,103,626 | B1 | 8/2015 | Heizer et al. | |
| 9,683,798 | B2 * | 6/2017 | Butler | F42B 39/02 |
| 2016/0313105 | A1 | 10/2016 | Olroyd | |
| 2020/0080825 | A1 | 3/2020 | Ortiz-rodriguez | |

OTHER PUBLICATIONS

Written Opinion of the ISA for PCT/FI2022/050538, mailed Nov. 22, 2022, 5 pages.
Search Report for FI20215918 dated Mar. 21, 2022, 1 page.

* cited by examiner

HOLDER DEVICE

This application is the U.S. national phase of International Application No. PCT/FI2022/050538 filed Aug. 18, 2022, which designated the U.S. and claims priority to FI patent application No. 20215918 filed Sep. 2, 2021, the entire contents of each of which are hereby incorporated by reference.

FIELD OF THE DISCLOSURE

The disclosure relates to a holder device for holding objects such as for example cartridges.

BACKGROUND

In many cases there is a need for a holder device for holding objects. For example, publication US20150265035 describes a holder device for an electronic apparatus such as a cellular phone. The holder device described in US20150265035 comprises a receiver that may capture one end of the apparatus, and a latch for holding the apparatus in its place. The receiver may engage five of the six sides of the apparatus. The holder device may have a belt clip and/or other means for attaching the holder device to a user's body or clothing. The holder device described in US20150265035 may be oriented in several different positions while keeping the apparatus in the holder device. The holder device described in US20150265035 can rotate 360 degrees while keeping the apparatus securely held until a user removes the apparatus. The holder device described in US20150265035 may be designed to work in conjunction with a removable case. The removable case may be a protective case that includes features that may engage matching features in the holder device. The matching features may include latch receptacles as well as a shape configured to fit into the receiver of the holder device.

A challenge concerning many holder devices of the kind described above is related to situations in which one or more objects being held by the holder device should be removable easily by using one hand only. A situation of the kind mentioned above can be present for example in conjunction with holder devices for carrying cartridges. A user, e.g. a hunter, needs one hand for carrying a gun, and therefore the cartridges must be removable from the holder device by using one hand only. Nevertheless, the holder device must securely and reliably hold the cartridges, even if the cartridges are easily removable from the holder device with one hand only. In many cases, secure and reliable holding and easy removal are factors which contradict each other, and thus there can be a need for a compromise with respect to these factors.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying and non-limiting embodiments.

In this document, the word "geometric" when used as a prefix means a geometric concept that is not necessarily a part of any physical object. The geometric concept can be for example a geometric point, a straight or curved geometric line, a geometric plane, a non-planar geometric surface, a geometric space, or any other geometric entity that is zero, one, two, or three dimensional.

In accordance with the invention, there is provided a new holder device for holding one or more objects such as for example cartridges. The holder device can be for example a portable device which can be e.g. carried on a belt of a user or otherwise attached to clothing of the user. It is also possible that a holder device according to an embodiment is installed on a vehicle or on a fixed structure such as a wall of a building.

A holder device according to the invention comprises:

- a holder body,
- a carrier element linearly moveable with respect to the holder body and configured to hold one or more objects, and
- a force generating system configured to generate force tending to move the carrier element in a first direction to a first position with respect to the holder body when the carrier element is in a second position away from the first position.

The carrier element comprises two wall sections parallel with and a distance away from each other and an intermediate section connected to the wall sections. The wall sections and the intermediate section constitute a trough having a longitudinal direction perpendicular to the first direction, a wider area closer to a bottom of the trough, and a narrower area farther from the bottom of the trough. As the trough has the wider area closer to the bottom and the narrower area farther from the bottom, the holder device can utilize a flange, a dove tail shape, or some other shape of the object to be held for holding the object. A rim of the holder body is configured to close at least the wider area of the trough when the carrier element is in the first position to prevent the one or more objects from moving in the longitudinal direction to and from the trough, and the wider area of the trough is farther in a second direction opposite to the first direction than the rim of the holder body when the carrier element is in the second position to allow the one or more objects to be moved in the longitudinal direction to and from the trough.

An object can be removed from the holder device by first drawing the object in the above-mentioned second direction or otherwise moving the carrier element so that the carrier element gets into the second position and then sliding the object in the above-mentioned longitudinal direction out from the trough. Thus, the removal is based on movements in two directions that are non-parallel, i.e. intersecting with each other, namely the second direction and the longitudinal direction of the trough. The object is securely held by the holder device because removal of the object from the holder device requires movements in the two non-parallel directions. An object can be supplied to the holder device by first moving the carrier element into the above-mentioned second position, then sliding the object into the trough in the longitudinal direction of the trough, and then releasing the carrier element to allow the force generating system to move the carrier element into the above-mentioned first position.

Exemplifying and non-limiting embodiments are described in accompanied dependent claims.

Various exemplifying and non-limiting embodiments both as to constructions and to methods of operation, together with additional objects and advantages thereof, will be best understood from the following description of specific exemplifying and non-limiting embodiments when read in connection with the accompanying drawings.

The verbs "to comprise" and "to include" are used in this document as open limitations that neither exclude nor require the existence of also un-recited features.

The features recited in dependent claims are mutually freely combinable unless otherwise explicitly stated.

Furthermore, it is to be understood that the use of "a" or "an", i.e. a singular form, throughout this document does not exclude a plurality.

BRIEF DESCRIPTION OF THE FIGURES

Exemplifying and non-limiting embodiments of the invention and their advantages are explained in greater detail below in the sense of examples and with reference to the accompanying drawings, in which.

DESCRIPTION OF EXEMPLIFYING AND NON-LIMITING EMBODIMENTS

The specific examples provided in the description below should not be construed as limiting the scope and/or the applicability of the accompanied claims. Lists and groups of examples provided in the description are not exhaustive unless otherwise explicitly stated.

Figure 1A:
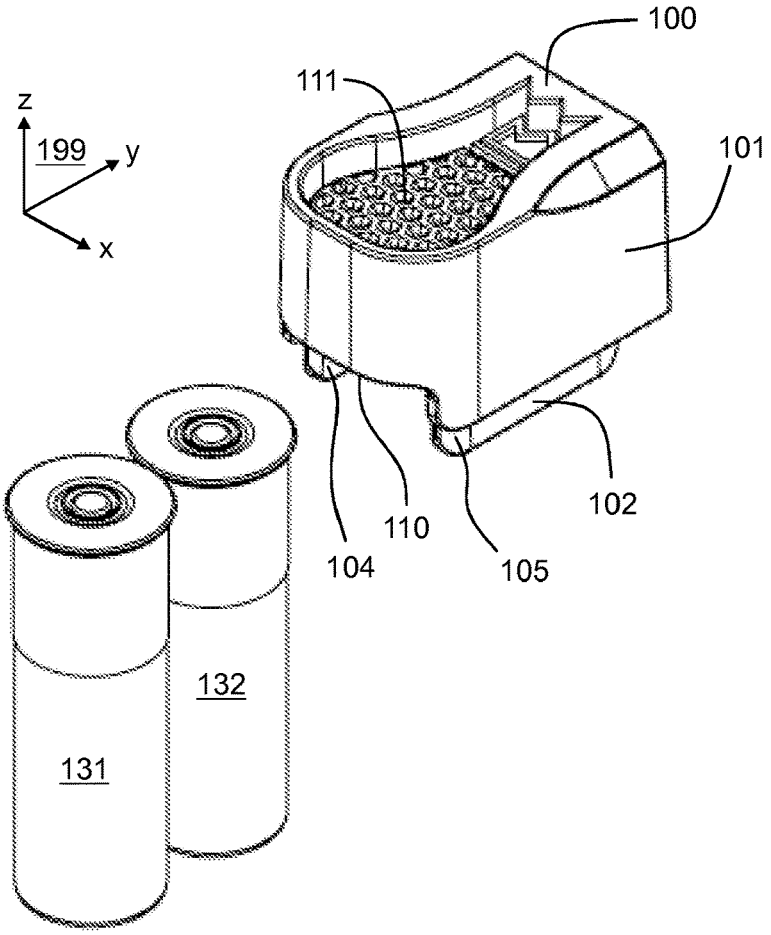
FIGS. 1*a*, 1*b*, 1*c*, 1*d*, 1*e*, 1*f*, 1*g*, 1*h*, and 1*i* illustrate a holder device according to an exemplifying and non-limiting embodiment.
Figure 4:
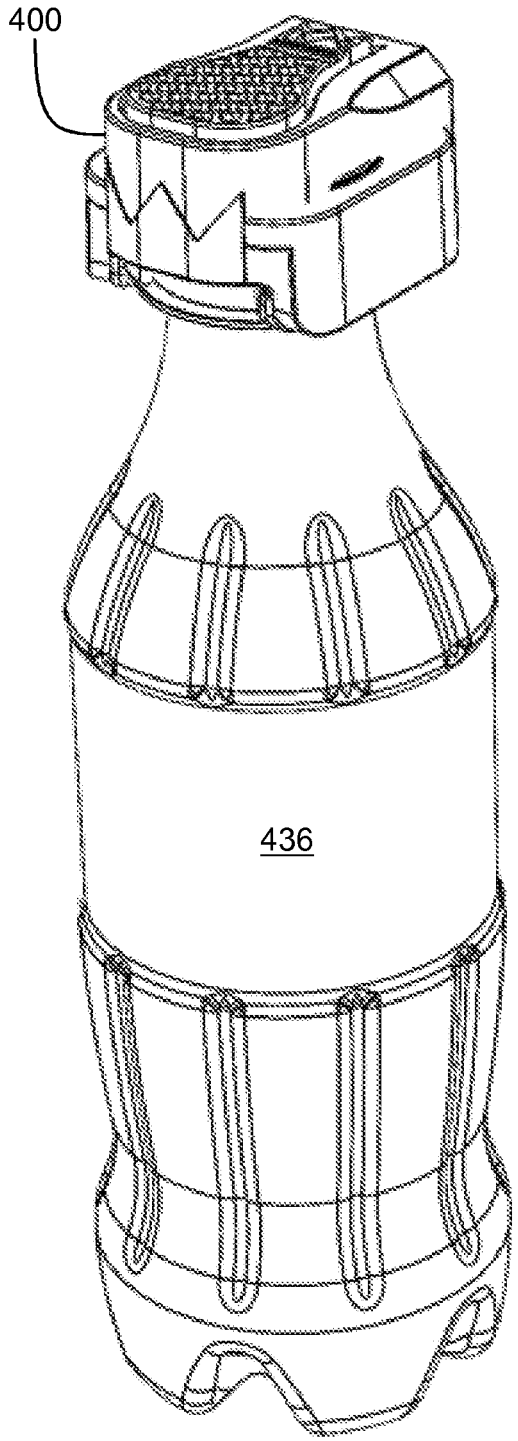
FIG. 4 illustrates a holder device according to an exemplifying and non-limiting embodiment.

FIG. 1*a* shows a holder device 100 according to an exemplifying and non-limiting embodiment. Furthermore, FIG. 1*a* shows objects 131 and 132 that can be held by the holder device 100. In this exemplifying case, the objects 131 and 132 are cartridges of a shotgun but it is to be noted that many different objects can be hold by the holder device 100. For example, FIG. 4 shows an exemplifying situation in which a holder device 400 according to an exemplifying and non-limiting embodiment is used for holding/carrying a bottle 436.

Figure 1B:
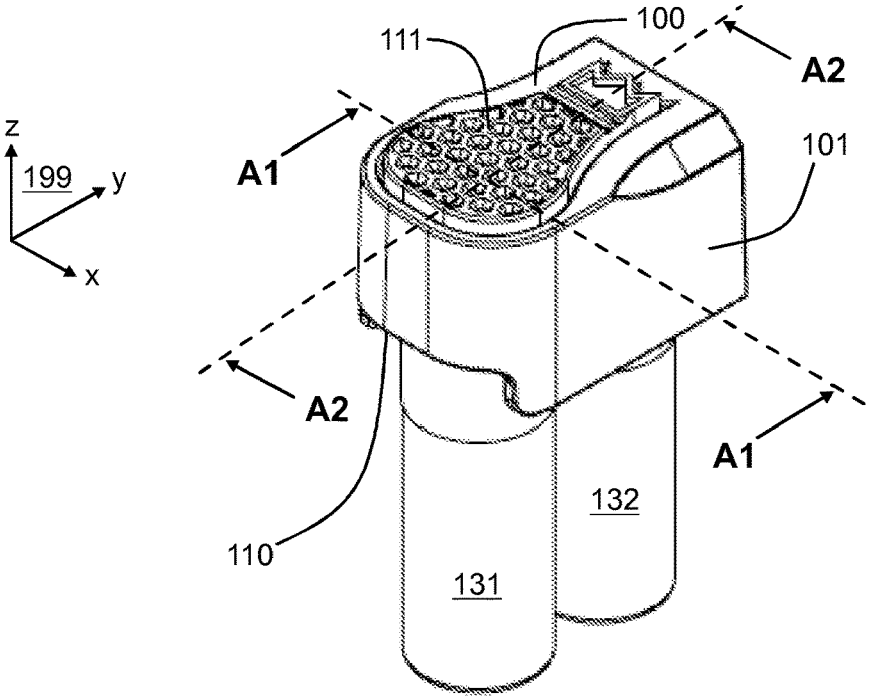
Figure 1C:
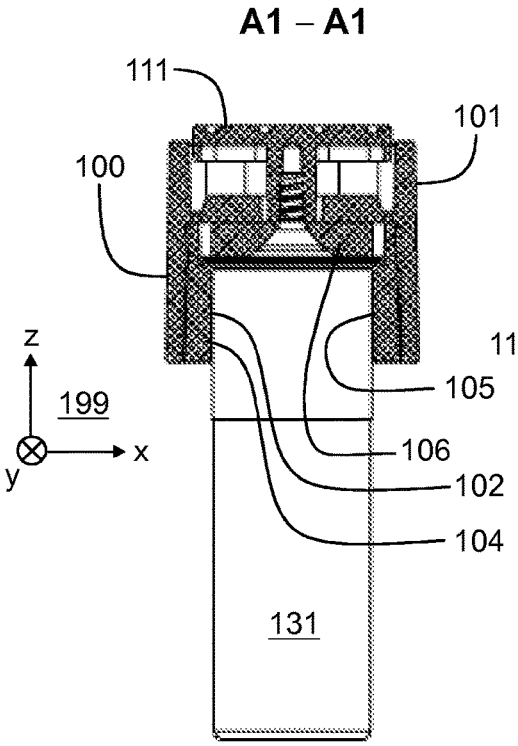
Figure 1D:
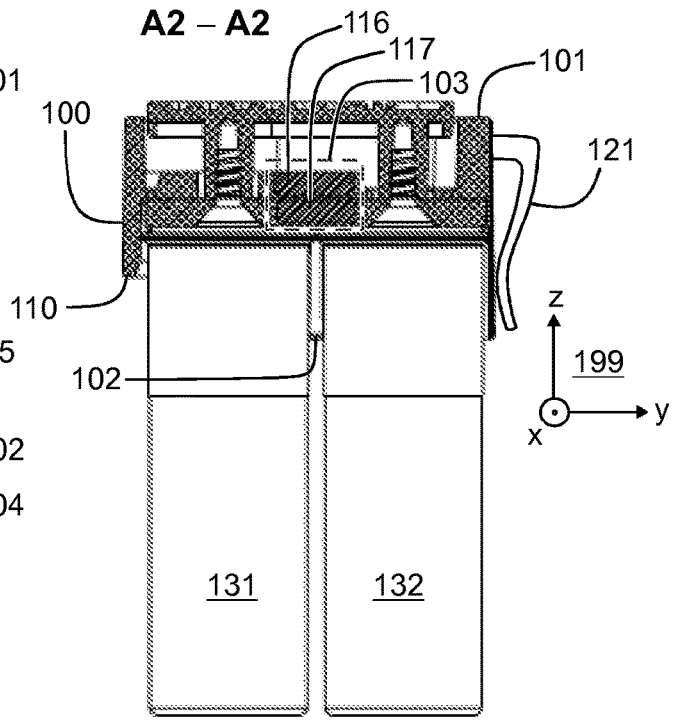

FIG. 1*b* shows a situation in which the objects 131 and 132 are held by the holder device. FIGS. 1*c* and 1*d* show sections of the holder device 100 taken along lines A1-A1 and A2-A2 shown in FIG. 1*b*, respectively. In FIG. 1*c*, the geometric section plane is parallel with the xz-plane of a coordinate system 199. In FIG. 1*d*, the geometric section plane is parallel with the yz-plane of the coordinate system 199. Section surfaces are depicted as cross-hatched areas in the accompanying figures.

The holder device 100 comprises a holder body 101 and a carrier element 102 that is linearly moveable with respect to the holder body 101 and suitable for holding the objects 131 and 132. The carrier element 102 is linearly movable in parallel with the z-axis of the coordinate system 199. The holder device 100 comprises a force generating system configured to generate force tending to move the carrier element 102 in a first direction to a first position with respect to the holder body 101 when the carrier element 102 is in a second position away from the first position. The first direction is the positive z-direction of the coordinate system 199. FIGS. 1*b*, 1*c*, and 1*d* show the holder device 100 in a situation in which the carrier element 102 is in the first position. FIG. 1*a* shows the holder device 100 in a situation in which the carrier element 102 is in the second position. FIGS. 1*g* and 1*h* show corresponding section views of the holder device 100 as FIGS. 1*c* and 1*d*, but in the situation shown in FIGS. 1*g* and 1*h* the carrier element 102 is in the second position. The force generating system is denoted with a reference 103 in FIGS. 1*d* and 1*h*.

Figure 1G:
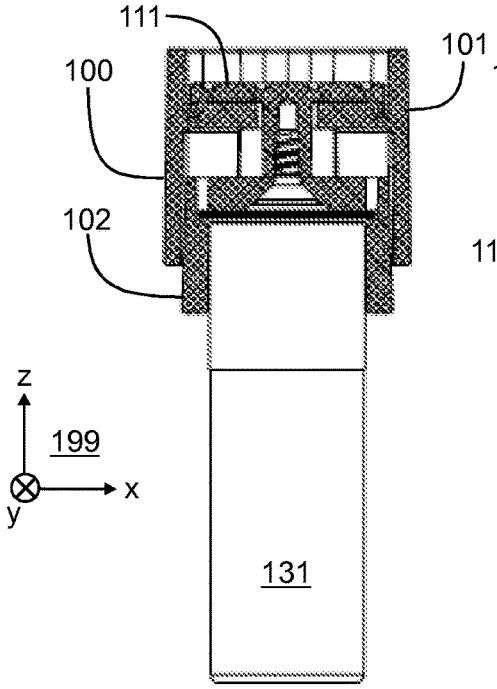
Figure 1H:
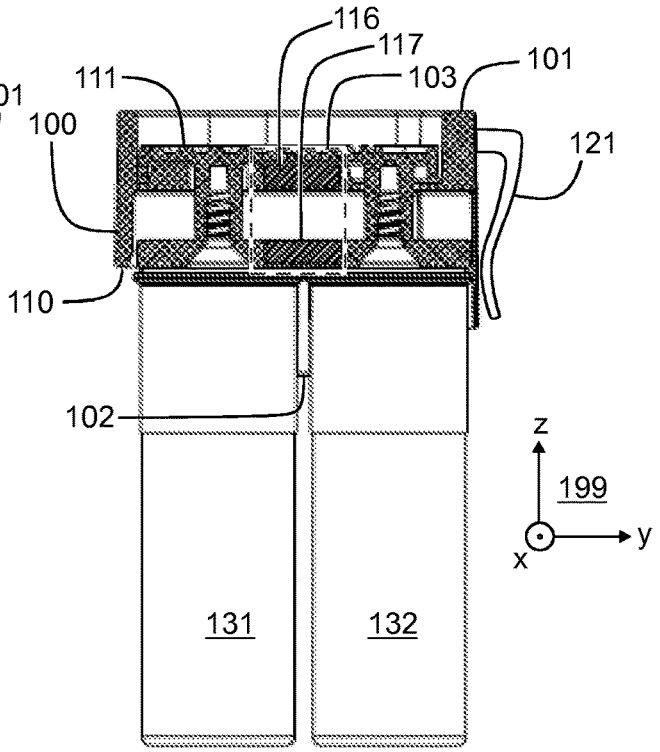
Figure 2:
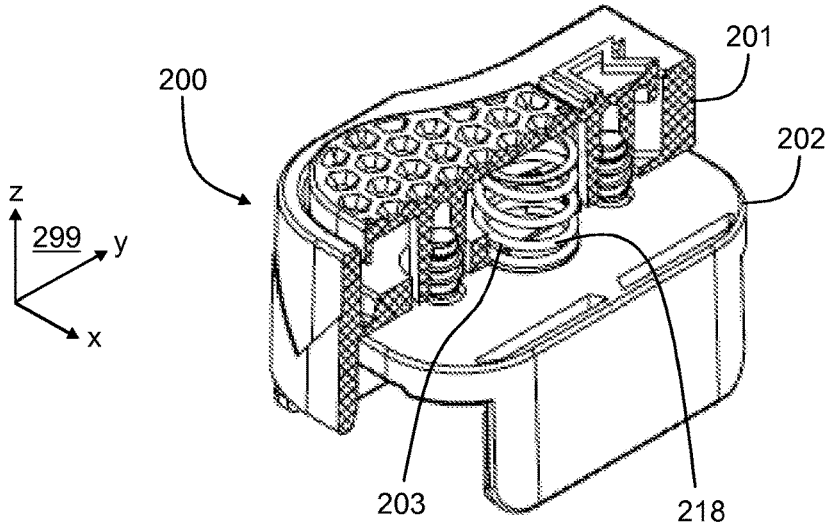
FIG. 2 illustrates a holder device according to another exemplifying and non-limiting embodiment.

In the exemplifying holder device 100, the force generating system 103 comprises pieces 116 and 117 of permanent magnet material configured to direct attractive magnetic forces to each other. When the carrier element 102 is in the second position as shown in FIGS. 1*a*, 1*g*, and 1*h*, the attractive magnetic forces tend to move the carrier element 102 in the first direction, i.e. in the positive z-direction, to the first position that is shown in FIGS. 1*b*, 1*c*, and 1*d*. It is also possible that one of the pieces 116 and 117 is made of ferromagnetic material and only the other one of the pieces 116 and 117 is made of permanent magnet material. Furthermore, a force generating system of a holder device according to an exemplifying and non-limiting embodiment can be implemented with other means too, such as for example a spring or an element of rubber or some other suitable flexible material. Therefore, holder devices according to embodiments of the invention are not limited to any specific means for implementing the force generating system. FIG. 2 illustrates a holder device 200 according to an exemplifying and non-limiting embodiment. The holder device 200 comprises a holder body 201, a carrier element 202, and a force generating system 203 that is implemented with a spring 218.

Figure 1E:
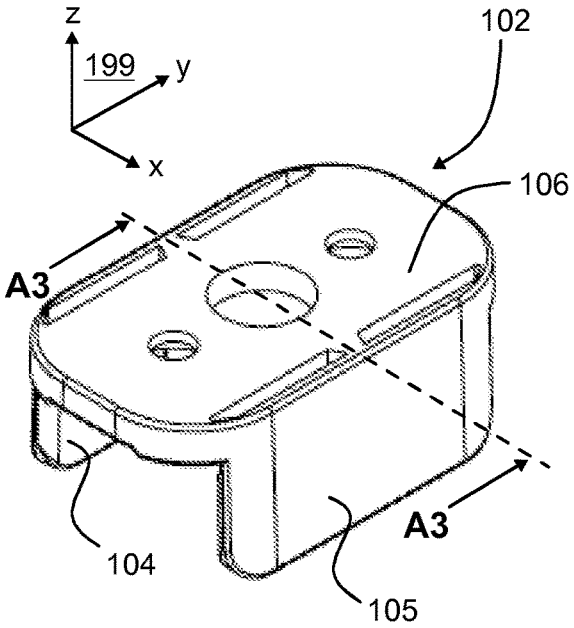
Figure 1F:
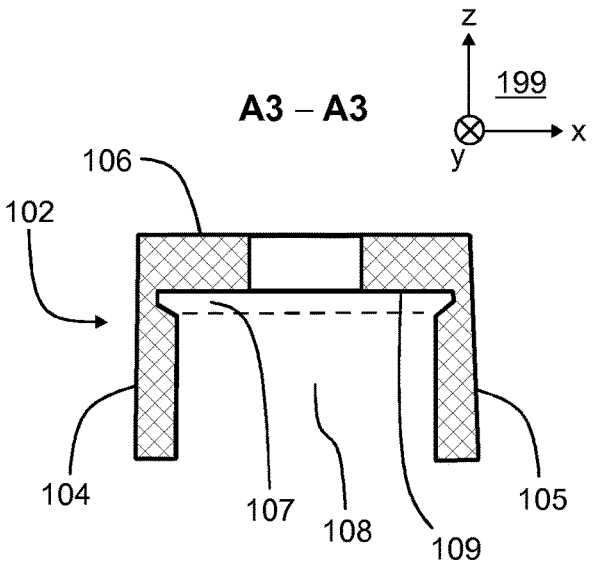

FIGS. 1*e* and 1*f* illustrate the carrier element 102 of the holder device 100. FIG. 1*f* shows a section taken along a line A3-A3 shown in FIG. 1*e*. The geometric section plane is parallel with the xz-plane of the coordinate system 199. The carrier element 102 comprises two wall sections 104 and 105 which are parallel with and a distance away from each other. The carrier element 102 comprises an intermediate section 106 that is connected to the wall sections 104 and 105. The wall sections 104 and 105 and the intermediate section 106 constitute a trough having a longitudinal direction perpendicular to the above-mentioned first direction, i.e. perpendicular to the positive z-direction of the coordinate system 199. The longitudinal direction of the trough is parallel with the y-axis of the coordinate system 199. As shown in FIG. 1*f*, the trough comprises a wider area 107 closer to a bottom 109 of the trough and a narrower area 108 farther from the bottom of the trough. In FIG. 1*f*, a dashed line is shown between the wider and narrower areas 107 and 108. The carrier element 102 can carry the objects 131 and 132 because a flange of each of the objects 131 and 132 fits with the wider area 107 as shown in FIGS. 1*c* and 1*g*. The wider area can as well be shaped to utilize a different shape of an object to be held, for example a spherical shape, a dove tail shape, or some other shape which enables carrying the object under consideration.

As illustrated in FIGS. 1*b* and 1*d*, a rim 110 of the holder body 101 is configured to close at least the wider area of the trough constituted by the carrier element 102 when the carrier element 102 is in the first position. This prevents the objects 131 and 132 from moving in the negative y-direction of the coordinate system 199 out from the trough constituted by the carrier element 102. As shown in FIG. 1*h*, the wider area of the trough is lower than the rim 110 of the holder body 101 when the carrier element 102 is in the second position. This allows the objects 131 and 132 to be moved in a direction parallel with the y-axis of the coordinate system 199 to and from the trough constituted by the carrier element 102.

The object 131 can be removed from the holder device 100 by first drawing the object 131 in the negative z-direction of the coordinate system 199 or otherwise moving the carrier element 102 in the negative z-direction so that the carrier element 102 gets into the second position shown in FIGS. 1*a*, 1*g*, and 1*h* and then sliding the object 131 in the negative y-direction out from the trough constituted by the carrier element 102. Thereafter, the object 132 can be removed in the same way. Thus, the removal is based on movements in two directions that are non-parallel i.e. intersecting with each other, namely the negative z-direction and the negative y-direction of the coordinate system 199. The objects 131 and 132 are securely held by the holder device 101 because removal of each object from the holder device requires movements in the two non-parallel directions. An object can be supplied to the holder device 101 by first moving the carrier element 102 into the above-mentioned second position shown in FIG. 1*a*, then sliding the object into the trough in the positive y-direction of the coordinate system 199, and then releasing the carrier element 102 to allow the force generating system 103 to move the carrier element 102 into the above-mentioned first position shown in FIGS. 1*b*, 1*c*, and 1*d*.

Figure 1I:
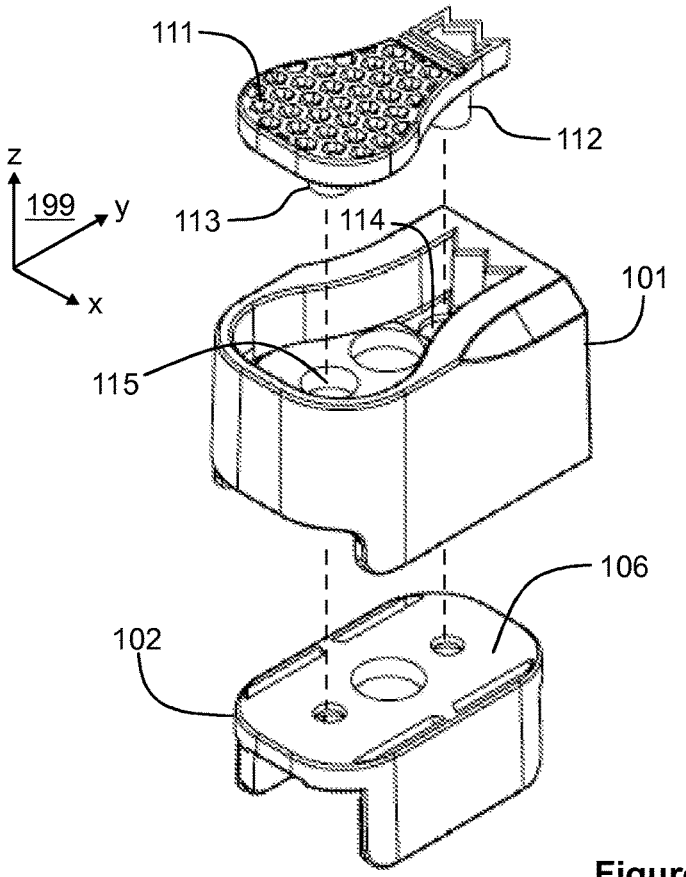

The exemplifying holder device 100 comprises a press-button 111 connected to the carrier element 102 and configured to move the carrier element 102 away from the first position shown in FIGS. 1*b*, 1*c*, and 1*d* to the second position shown in FIGS. 1*a*, 1*g*, and 1*h* in response to pushing the press-button 111. FIG. 1*i* shows an exploded view presenting the holder body 101, the carrier element 102, and the press-button 111. In this exemplifying holder device 100, the press-button 111 is connected to the intermediate section 106 of the carrier element 102 with the aid of isthmuses 112 and 113 shown in FIG. 1*i*. The isthmuses 112 and 113 are projecting portions joining the press-button 111 and they protrude through apertures 114 and 115 of a part of the holder body 101 so that the press-button 111 is on one side of this part of the holder body 101 and the intermediate section 106 is on an opposite side of the part of the holder body 101. It is also possible that a wall section, such as the wall section 105 of the carrier element 102, is provided with an overhang or another part with the aid of which the carrier element can be drawn in the negative z-direction of the coordinate system 199.

In the exemplifying holder device 100, the holder body 101 comprises a clip 121 suitable for attaching to clothing of a user, e.g. to a belt of the user. It is also possible that a holder device according to an exemplifying and non-limiting embodiment is installed on a vehicle or on a fixed structure such as a wall of a building.

Figure 3A:
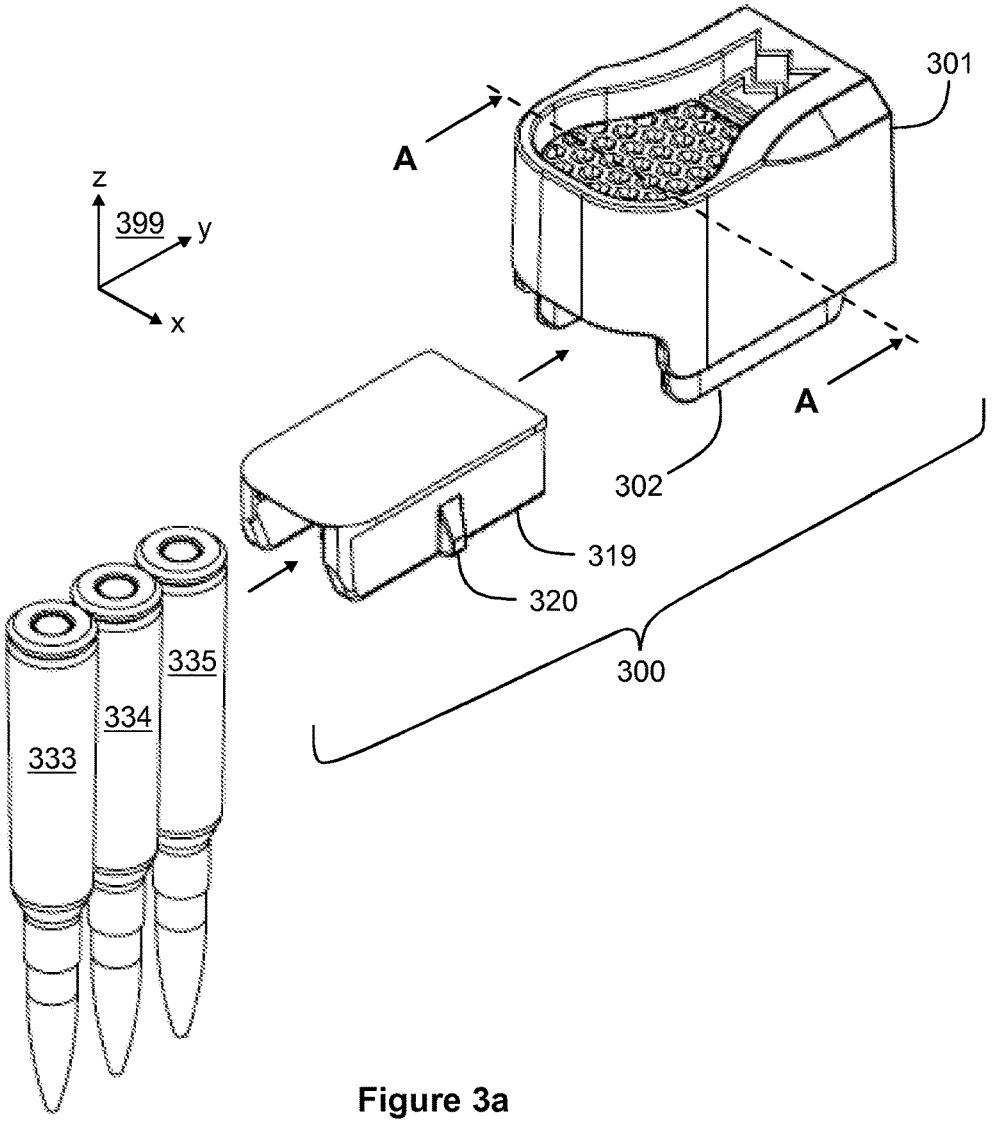
FIGS. 3*a* and 3*b* illustrate a holder device according to an exemplifying and non-limiting embodiment.
Figure 3B:
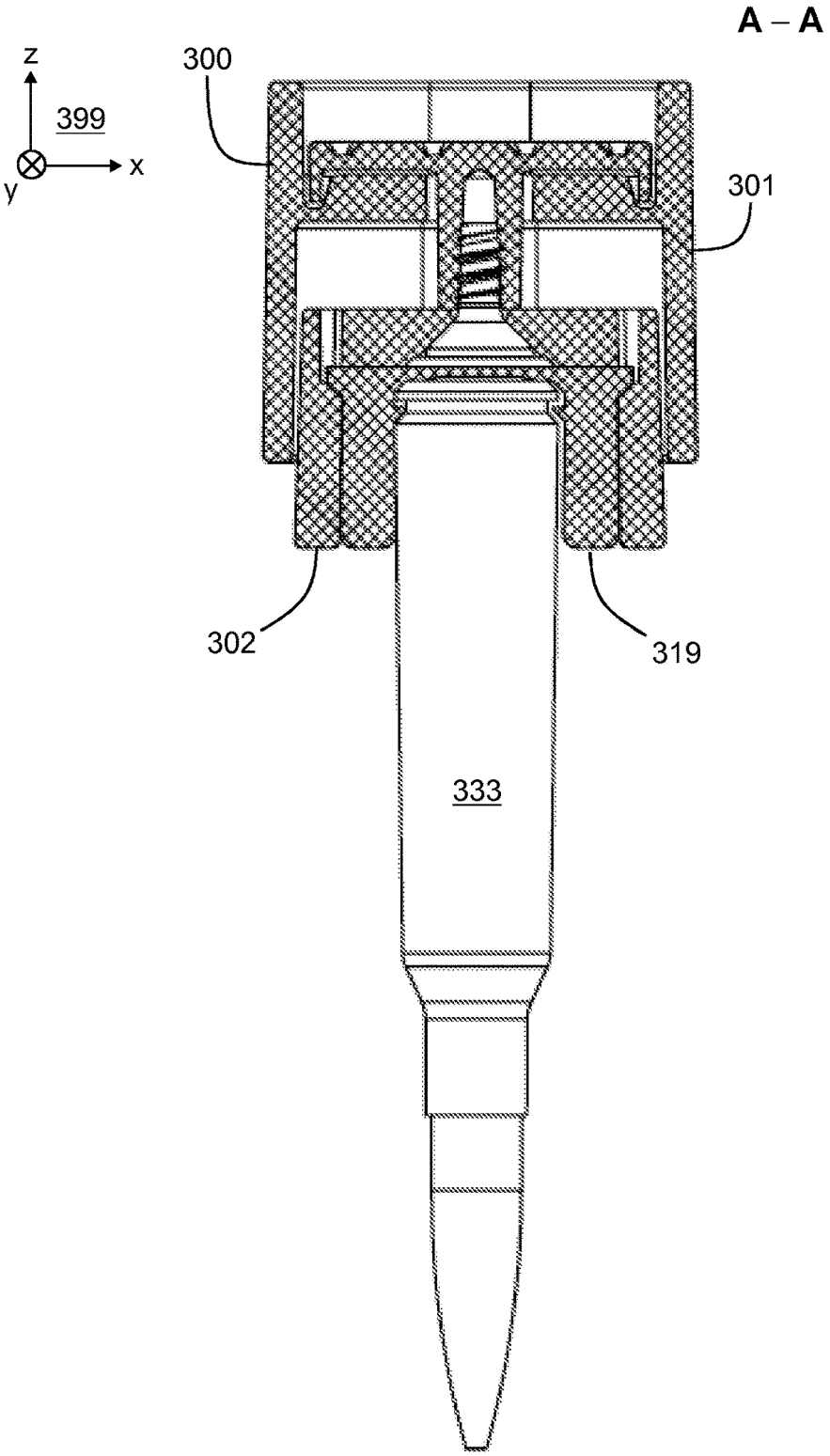

FIG. 3*a* illustrates a holder device 300 according to an exemplifying and non-limiting embodiment. FIG. 3*b* shows a section of the holder device 300 taken along a line A-A shown in FIG. 3*a*. The geometric section plane is parallel with the xz-plane of a coordinate system 399. The holder device 300 comprises a holder body 301, a carrier element 302, and a force generating system that is not shown in FIG. 3. The force generating system can be, for example but not necessarily, such as illustrated in FIGS. 1*d* and 1*h* or such as illustrated in FIG. 2. The holder device 300 further comprises an adapter 319 attachable to the trough constituted by the carrier element 302. The adapter 319 constitutes a narrower trough that is suitable for holding objects 333, 334, and 335 which are too narrow to be carried by the carrier element 302. In this exemplifying case, the adapter 319 comprises claws configured to provide shape-locking with the carrier element 302. In FIG. 3*a*, one of the claws is denoted with a reference 320. Different mechanical arrangements, e.g. one or more screws, for attaching the adapter 319 to the carrier element 302 are also possible. It is also possible that there is no locking arrangement between the adapter and the carrier element 302. In this case, the adapter can be removed together with one or more objects being held. In the exemplifying case shown in FIG. 3*a*, the objects 333, 334, and 335 are cartridges of a rifle. The holder device 300 can be adapted to be suitable for different objects with the aid of object-specific adapters. Thus, a holder device according to an exemplifying and non-limiting embodiment comprises a first adapter and at least one second adapter constituting a trough different from the trough constituted by the first adapter so that these adapters can carry different objects. Advantageously, the adapters are replaceable components.

The specific examples provided in the description given above should not be construed as limiting the scope and/or the applicability of the appended claims. Lists and groups of examples provided in the description given above are not exhaustive unless otherwise explicitly stated.

What is claimed is:

1. A holder device comprising:

a holder body, a carrier element linearly moveable with respect to the holder body and configured to hold one or more objects, and a force generating system configured to generate force tending to move the carrier element in a first direction to a first position with respect to the holder body when the carrier element is in a second position away from the first position, wherein the carrier element comprises two wall sections parallel with and a distance away from each other and an intermediate section connected to the wall sections, the wall sections and the intermediate section constituting a trough having a longitudinal direction perpendicular to the first direction, a wider area closer to a bottom of the trough, and a narrower area farther from the bottom of the trough, wherein a rim of the holder body is configured to close at least the wider area of the trough when the carrier element is in the first position to prevent the one or more objects from moving in the longitudinal direction out from the trough, and the wider area of the trough is farther in a second direction opposite to the first direction than the rim of the holder body when the carrier element is in the second position to allow the one or more objects to be moved in the longitudinal direction out from the trough.

2. A holder device according to claim 1, wherein the holder device comprises a press-button connected to the carrier element and configured to move the carrier element away from the first position to the second position in response to pushing the press-button.

3. A holder device according to claim 2, wherein the press-button is connected to the intermediate section of the carrier element with one or more isthmuses protruding through one or more apertures of a part of the holder body so that the press-button is on one side of the part of the holder body and the intermediate section is on an opposite side of the part of the holder body.

4. A holder device according to claim 1, wherein the holder device further comprises a first adapter attachable to the trough and constituting a narrower trough suitable for holding one more other objects which are too narrow to be carried by the carrier element.

5. A holder device according to claim 4, wherein the first adapter comprises one or more claws configured to provide shape-locking with the carrier element.

6. A holder device according to claim 4, wherein the holder device further comprises at least one second adapter attachable to the trough and constituting a trough different from the trough constituted by the first adapter.

7. A holder device according to claim 1, wherein the force generating system comprises a spring.

8. A holder device according to claim 1, wherein the force generating system comprises pieces of permanent magnet material configured to direct magnetic forces to each other.

9. A holder device according to claim 1, wherein the force generating system comprises a piece of permanent magnet material and a piece of ferromagnetic material configured to direct magnetic forces to each other.

10. A holder device according to claim 1, wherein the holder body comprises a clip suitable for attaching to clothing.

11. A holder device according to claim 2, wherein the holder device further comprises a first adapter attachable to the trough and constituting a narrower trough suitable for holding one more other objects which are too narrow to be carried by the carrier element.

12. A holder device according to claim 11, wherein the first adapter comprises one or more claws configured to provide shape-locking with the carrier element.

13. A holder device according to claim 3, wherein the holder device further comprises a first adapter attachable to the trough and constituting a narrower trough suitable for holding one more other objects which are too narrow to be carried by the carrier element.

14. A holder device according to claim 13, wherein the first adapter comprises one or more claws configured to provide shape-locking with the carrier element.

15. A holder device according to claim 5, wherein the holder device further comprises at least one second adapter attachable to the trough and constituting a trough different from the trough constituted by the first adapter.

16. A holder device according to claim 11, wherein the holder device further comprises at least one second adapter attachable to the trough and constituting a trough different from the trough constituted by the first adapter.

17. A holder device according to claim 12, wherein the holder device further comprises at least one second adapter attachable to the trough and constituting a trough different from the trough constituted by the first adapter.

18. A holder device according to claim 13, wherein the holder device further comprises at least one second adapter attachable to the trough and constituting a trough different from the trough constituted by the first adapter.

19. A holder device according to claim 14, wherein the holder device further comprises at least one second adapter attachable to the trough and constituting a trough different from the trough constituted by the first adapter.

20. A holder device according to claim 2, wherein the force generating system comprises a spring.

* * * * *